US005339001A

United States Patent [19]

King et al.

[11] Patent Number: 5,339,001

[45] Date of Patent: Aug. 16, 1994

[54] ELECTRIC LAMP HAVING IMPROVED SUPPORT STRAPS FOR PLANAR SEALS

[75] Inventors: Norman R. King, Hammondsport; Jiri Sip; Antonin J. Dvorak, both of Painted Post, all of N.Y.

[73] Assignee: North American Philips Corporation, New York, N.Y.

[21] Appl. No.: 961,564

[22] Filed: Oct. 15, 1992

[51] Int. Cl.[5] ..... H01J 5/00

[52] U.S. Cl. ..... 313/25; 313/634

[58] Field of Search ..... 313/25, 634, 318, 292

[56] References Cited

U.S. PATENT DOCUMENTS

| | | | |
|---|---|---|---|
| 2,677,068 | 4/1954 | Martt | 313/25 |
| 2,830,210 | 4/1958 | Jenne, Jr. et al. | 313/25 |
| 2,918,592 | 12/1959 | Pomfrett et al. | 313/25 |
| 3,094,640 | 6/1963 | Gustin | 313/25 |
| 3,424,935 | 1/1969 | Gungle et al. | 313/25 |
| 3,484,637 | 12/1969 | Van Brost et al. | 313/25 |
| 3,803,435 | 4/1974 | Fitzgerald et al. | 313/25 |
| 4,866,328 | 9/1989 | Ramaiah et al. | 313/25 |
| 5,079,480 | 1/1992 | Canale et al. | 315/47 |

FOREIGN PATENT DOCUMENTS

| | | | |
|---|---|---|---|
| 1-236571 | 9/1989 | Japan | 313/25 |

*Primary Examiner*—Donald J. Yusko
*Assistant Examiner*—Nimesh D. Patel
*Attorney, Agent, or Firm*—Brian J. Wieghaus

[57] ABSTRACT

An electric lamp having a light source capsule with a generally planar press seal, having two opposing major faces and two minor faces extending therebetween, includes an improved support strap for securing the seal to a frame support rod. The support strap includes a stiffly resilient strip of metal having two spaced and opposing major leg portions each extending in contact with a respective major seal face, an elastically deformable jaw portion substantially not in contact with a seal face, and end portions fixed to each other adjacent one of the seal faces. The elastically deformable portion is arranged such that with the strap end portions fixed to each other it is elastically deformed and firmly biases other portions of the support strap against at least two of the seal faces for holding the seal therebetween. The elastically deformable portion is dimensioned such that the seal is firmly held by the strap despite the usual lamp-to-lamp variations in seal dimensions which occur during high speed lamp manufacture, obviating the need for hand fitting or expensive and complicated strap fitting equipment.

24 Claims, 2 Drawing Sheets

ELECTRIC LAMP HAVING IMPROVED SUPPORT STRAPS FOR PLANAR SEALS

BACKGROUND OF THE INVENTION

1. Field of the Invention

The invention relates to electric lamps having light source capsules with generally planar seals, and more particularly, to an improved support strap for these seals and an improved support frame incorporating these straps.

2. Description of the Prior Art

Electric lamps which have a light source capsule with a generally planar seal(s) include, among others, high intensity discharge (HID) metal halide and mercury vapor lamps. The light source capsule in these lamps is a discharge vessel of fused silica (quartz glass) which typically is sealed at both ends by a press seal which includes two major, substantially parallel faces and two minor, side faces extending between the major faces. Conductive lead-throughs extend through the press seal in a gas-tight manner to a pair of discharge electrodes arranged within the discharge vessel.

These lamps typically have an outer envelope which is sealed at one end by a lamp stem. A frame consisting of metallic support rods extends from the lamp stem and supports the discharge vessel within the outer envelope. Metallic support straps secured about the press seals are welded to a support rod on one or both sides of the press seal to secure the discharge vessel to the frame.

The pressing of hot fused silica produces significant variations in the resulting press seals in both width and thickness during high speed lamp manufacture. These dimensional variations present difficulties in achieving satisfactory strap designs. Many of the designs require hand fitting and adjusting of the straps on each discharge vessel during assembly of the frame to achieve a discharge vessel mount which is sufficiently rigid to pass the pre-shipment 30" drop test criteria which is common in the industry.

One strap design utilizes thin metal strips placed above and below the major faces of the press seal. The strips are placed, formed about the press seal and welded to the frame by an automatic assembly machine. The strips are thin and flexible so that when they are formed about the press seal they do not break or chip the seals. Such a strap is shown for example in U.S. Pat. No. 3,424,935 (Gungle et al). This strap design has the disadvantage that the automatic assembly machines which are required to place and form the strips around the pinch seals and to weld the strips to the support frame are very expensive to design and build, or purchase. Additionally, the straps of Gungle '935 are welded on both sides of the seals to respective support rods which extend adjacent to each minor seal face.

U.S. Pat. No. 2,830,210 (Jenne, Jr. et al.) discloses a single-piece support strap which is designed both for planar seals and for seals having a circular cross-section. The strap includes an expanded center portion which engages only the minor faces of a press seal. On either side of the expanded center portion is a doubled leg part, one of which is creased and the other which includes the free ends of the strap welded together. The doubled leg parts provide a clamping force on the minor faces of the seal. The strap does not include any portions which extend in contact with the major faces of the seal. The straps are also welded to support rods extending opposite both major seal faces.

U.S. Pat. No. 2,918,592 (Pomfrett et al.) discloses a single piece strap which bends around the press seal at one minor face thereof. Its ends are welded together adjacent the other minor face and to a single support rod extending along one side of the discharge vessel. One portion of the strap has a channel shape which provides rigidity and extends along a major face of the seal. The remaining portions of the strap are "soft" and bend around both minor faces and the opposing major face of the press seal. From the design, it is evident that the strap holds the press seal with a force solely determined by the tension with which the "soft" portion can be held against the strap when it is welded to the channel portion. To achieve an acceptable fit despite the normal lamp-to-lamp variations in press seal dimensions, such a strap would also require hand fitting on each seal or an expensive automatic assembly machine.

Additionally, a well-known characteristic of lamps which have a fused silica discharge vessel and an ionized plasma of alkali-halides during lamp operation, such as metal halide lamps, is the increase of lamp voltage that occurs over the lifetime of such lamps due to the diffusion of sodium ions through the heated discharge vessel. Sodium diffusion is accelerated by the presence of negative space charges on the outer surface of the discharge vessel. The negative space charges occur if ultraviolet radiation from the discharge strikes current carrying metal components within the lamp, which causes the production of photoelectrons.

In such lamps it is desirable to cover exposed metal parts with a material impervious to ultraviolet radiation and having a high photo electric work function, for example, as disclosed in U.S. Pat. Nos. 3,484,637 (Van Boort et al.) and 4,866,328 (Ramaiah et al). Another approach is to reduce the amount of metal in close proximity and in direct view of the discharge vessel, as in the above patent to Gungle which eliminates the elongate support rod extending adjacent the discharge vessel. However, the Gungle lamp still has a significant amount of metal parts since it includes two axially extending support rods connected to each of the support straps. Since ultraviolet radiation from the discharge vessel is also reflected off the inner surface of the outer envelope, these metal parts are still a source of a significant amount of photoelectrons.

SUMMARY OF THE INVENTION

It is an object of the invention to provide an electric lamp with an improved support strap which is easy to assemble onto the light source capsule and which firmly holds a planar seal, without damaging or cracking it, despite the normal lamp-to-lamp variations in the seal dimensions during high speed lamp manufacture.

Another object is to accomplish the above purpose with a strap that does not require hand fitting or expensive, complex machinery to assemble and secure the strap on the seal.

Still another object of the invention is to provide an improved frame structure within the outer envelope of lamps having an alkali-halide containing discharge vessel.

According to the invention, an electric lamp includes a light source capsule having a generally planar seal having two major, substantially parallel faces and two minor faces extending therebetween. A metallic support rod extends adjacent a minor face of the seal. A support strap for holding the seal comprises a stiffly resilient strip of metal having two spaced and opposing major leg portions each extending in contact with a respective major seal face, an elastically deformable jaw portion the major part of which is not in contact with a said seal face, and end portions fixed to each other adjacent one of said minor seal faces. The elastically deformable portion is arranged such that with the end portions closed together, the elastically deformable portion is elastically deformed and firmly biases said support strap against at least one of (a) both of said major seal faces and (b) both of said minor seal faces, for holding said seal therebetween. Favorably, the strap consists of a single strip of said stiffly resilient material.

With the strap design according to the invention, it has been found that the seal is firmly held despite the normal lamp-to-lamp variations in seal dimensions. Since the holding is achieved through elastic deformation of the elastically deformable jaw portion simply upon the squeezing together of the free ends of the strap, neither manual adjustment nor expensive and complicated assembly equipment is required. In contrast to the strap of Jenne '210 discussed above, the strap according to the invention extends along both major seal faces while Jenne's straps are widely spaced from the major seal faces and only contact the minor faces. The strap of Jenne '210 would not be feasible for use with frames having only one support rod adjacent each press seal.

Preferably, the elastically deformable jaw portion is arranged such that the strap is firmly biased against both of the minor and both of the major seal faces to ensure the secure holding of the seal.

According to a favorable embodiment, the elastically deformable jaw portion includes a generally U-shaped portion having arms extending generally transversely from respective ones of the major leg portions, one of the arms being longer than the other and extending in contact with a minor seal face.

The strap may also include a second elastically deformable jaw portion adjacent the other minor seal face. Each of the first and second elastically deformable jaw portions may be dimensioned for biasing the strap against one or both pairs of seal faces.

According to another embodiment, the lamp is a high pressure discharge lamp having a discharge vessel with planar press seals at each end thereof and arranged axially within the outer envelope. The frame includes a first frame section extending from a conventional lamp stem adjacent the press seal facing the stem and a second frame section engaging the dome end of the outer envelope and extending axially to the press seal facing the dome end of the envelope. A support strap as described above secures each press seal to a respective frame section, which includes only one support rod extending along a minor face of the respective press seal. The rods terminate at their respective seals and do not extend along the body of the discharge vessel.

The above structure is advantageous because it minimizes the amount of metal in the frame structure while providing a frame which can reliably pass a standard drop test. It is particularly advantageous for lamps with alkali-halide containing discharge vessels, such as metal halide lamps, because the photoelectron emission and thus the depletion of sodium from the discharge vessel will be correspondingly reduced.

These and other aspects of the invention are more fully described with reference to the following drawings and detailed description.

DESCRIPTION OF THE PREFERRED EMBODIMENTS

Figure 1:
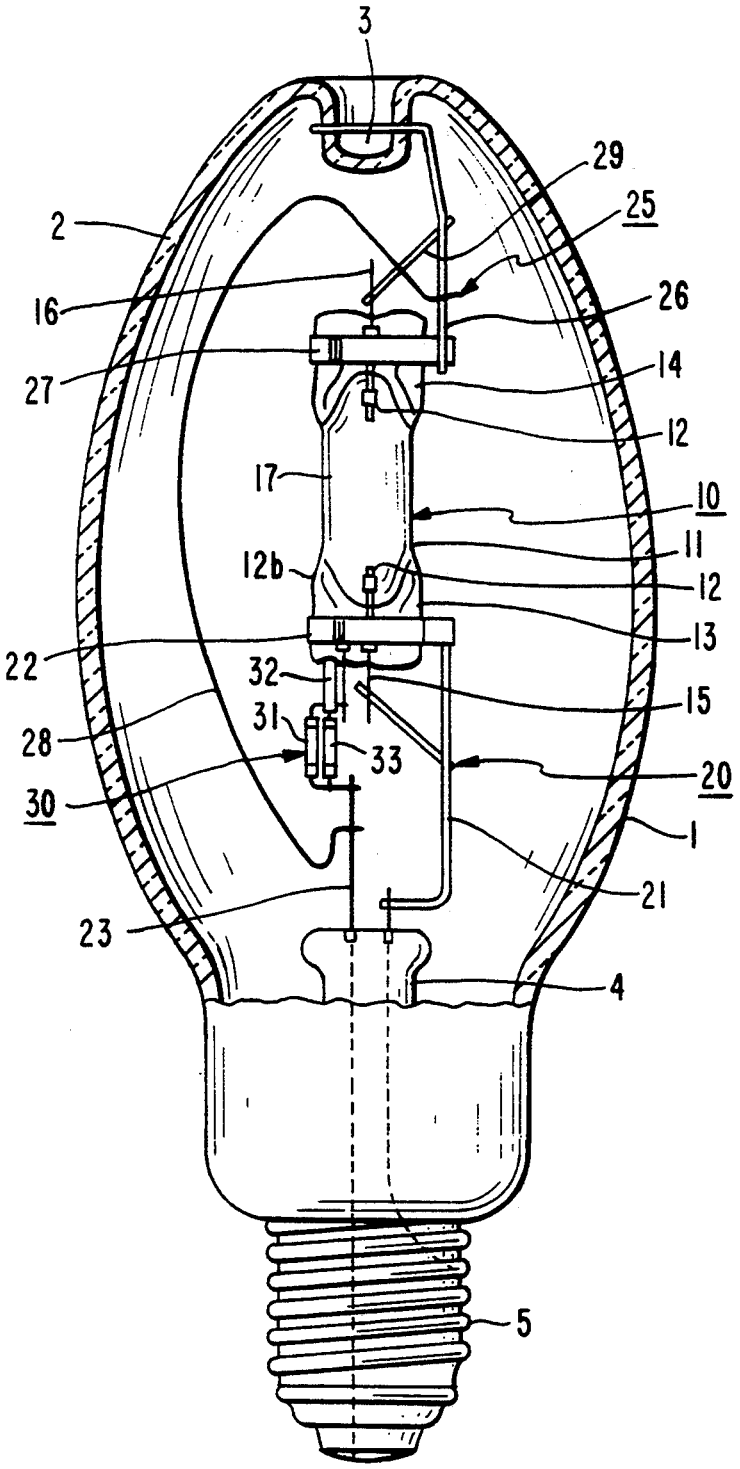
FIG. 1 illustrates a metal halide lamp having a discharge vessel sealed at each end by planar press seals and secured to a support frame by a respective support strap according to the invention.

FIG. 1 shows a metal halide (HID) lamp having an outer lamp envelope 1 with a dome portion 2 which includes an inwardly extending dimple 3. A conventional lamp stem 4 seals the base end of the outer envelope in a gas-tight manner. A conventional screw base 5 is arranged on the envelope.

Arranged within the envelope is a light source capsule 10 comprised of a conventional discharge vessel 11 of fused silica (quartz) glass which encloses a discharge space and in which a pair of discharge electrodes 12 are arranged at opposite ends of the discharge space. The ends of the discharge vessel are sealed by generally planar press seals 13, 14 through which electrically conductive lead-throughs 15, 16 extend to the discharge electrodes in a gas-tight manner. The discharge vessel includes a conventional discharge sustaining filling of mercury, a rare gas, and one or more metal alkali-halides, such as a sodium halide.

The discharge vessel is supported within the outer envelope by a frame consisting of first and second frame sections 20, 25. The first frame section 20 extends from the lamp stem 4 and includes a metallic support rod 21 extending adjacent a minor face of the press seal 13 facing the stem. The second frame section 25 includes a support rod 26 contacting the dimple 3 at the dome end of the lamp envelope and extending axially adjacent a minor face of the other press seal 14. Metallic support straps 22, 27 extend about each press seal and are welded to respective ones of the support rods 21, 26.

The electrodes 12 are connected to respective contacts on the base 5 by a conventional field wire 28 connected to current conductor 23 and conductive support rod 26, which is connected to lead-through 16 by conductive strap 29, and by conductive strap 24 connecting the conductive support rod 21 to lead-through 15. The auxiliary, starting electrode **12*b* is connected to current-conductor 23 through starting circuit 30 which consists of an insulative bridge 31, bimetal 32 and resistor 33**. This starting circuit is more fully described in U.S. Pat. No. 5,079,480 (Canale et al.), herein incorporated by reference.

According to the invention, each support strap consists of a single stiffly resilient strip of metal having two spaced and opposing major leg portions **22*a*, *b* each contacting a respective major seal face 13*a*, 13*b*. (FIGS. 2, 3) An elastically deformable jaw portion 22*c* connects the two major leg portions adjacent one of the minor seal faces 13*c*. End portions 22*d*,*e* of the support strap are fixed to each other, by welding for example, adjacent the other minor seal face 13*d*. The elastically deformable jaw portion 22*c* is generally U-shaped and has opposing arms 22***g, f* extending generally transversely from respective ones of the major leg portion 22*a, b*. The arm 22*f* is longer than arm 22*g* and extends in contact with minor face 13*c*. The major part of the jaw portion 22*c* is spaced from and not in contact with the adjacent seal face. The strap includes a second elastically deformable jaw portion 22*h* including an arcuate portion 22*i* and an arm 22*j*, adjacent the other minor seal face 13*d* and strap end portion 22*d*.

The elastically deformable jaw portion 22*c* is arranged such that with the end portions 22*d, e* fixed together the elastically deformable portion 22*c* is elastically deformed from its unloaded shape and firmly biases the opposing leg portions 22*a, b* against the major seal faces 13*a, b* and the arms 22*f* and 22*j* against the minor seal faces 13*c, d*. The contact points between the strap and the seal are labelled in FIG. 2 as "C1"–"C6".

The support strap has a width and thickness dimension which is uniform over its entire length.

Figure 2:
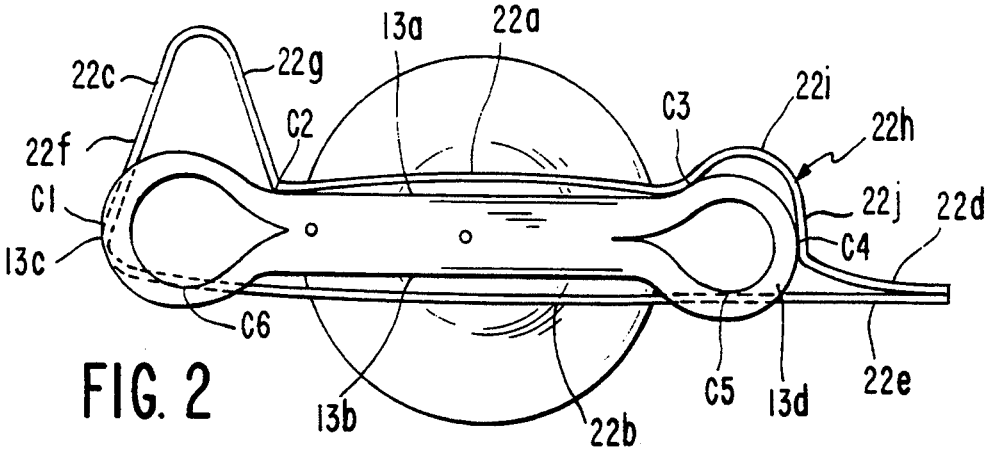
FIGS. 2 and 3 are end views of the support strap according to the invention in various stages of mounting on a press seal.
Figure 3:
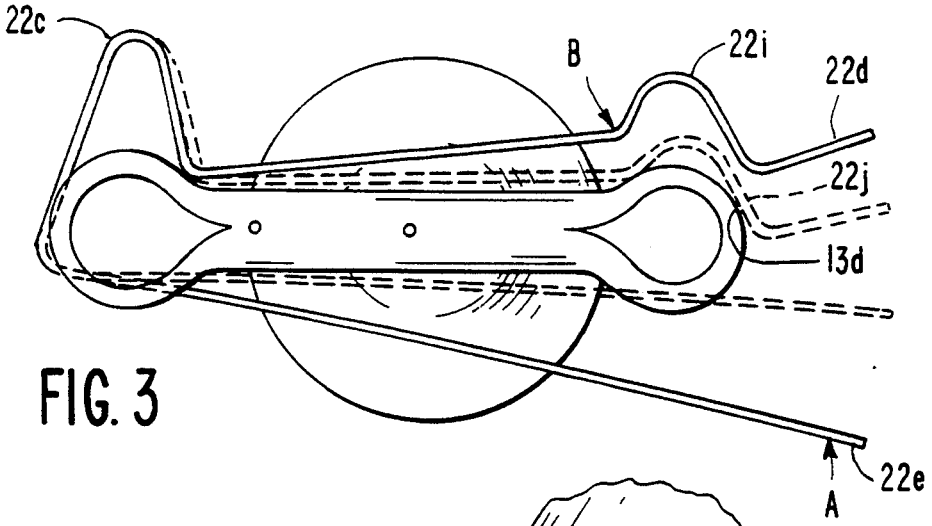

As shown in FIG. 3, the end portions 22*d, e* of the support strap are splayed open initially to permit easy assembly of the strap over the press seal or insertion of the press seal into the strap. The splayed-open shape is shown in solid lines. As shown in dashed lines, when the end portions 22*d, e* are closed towards each other, the arm 22*j* of the second elastically deformable portion contacts the upper edge of seal face 13*d*. As the ends are further closed towards each other, this arm 22*j* rides over this edge, deforming portion 22*c* as well as 22*i*. With the end portions fully closed as shown in FIG. 2, the strap firmly contacts the press seal at points C1–C6 with the major leg portions 22*a, b* slightly bowed. The elastically deformable portions 22*c* and 22*i* are dimensioned so that the desired clamping force is achieved for the expected variations in the width and thickness of the press seal which occur during high speed lamp manufacture.

The strap is readily secured on the press seal as follows. Once the strap is arranged over the seal in the splayed open position, the end portions are squeezed together by a conventional welding electrode acting on end portion 22*e* in the direction indicated by arrow "A" and by an auxiliary tool acting at the bend between major leg portion 22*a* and the portion 22*i* in the direction indicated by arrow "B". (FIG. 3) With the end portions closed together, they are welded to each other in a conventional manner by bringing another welding electrode into contact with end portion 22*d*. The end portions may then be welded to the respective support rod 21 or 26.

Figure 4:
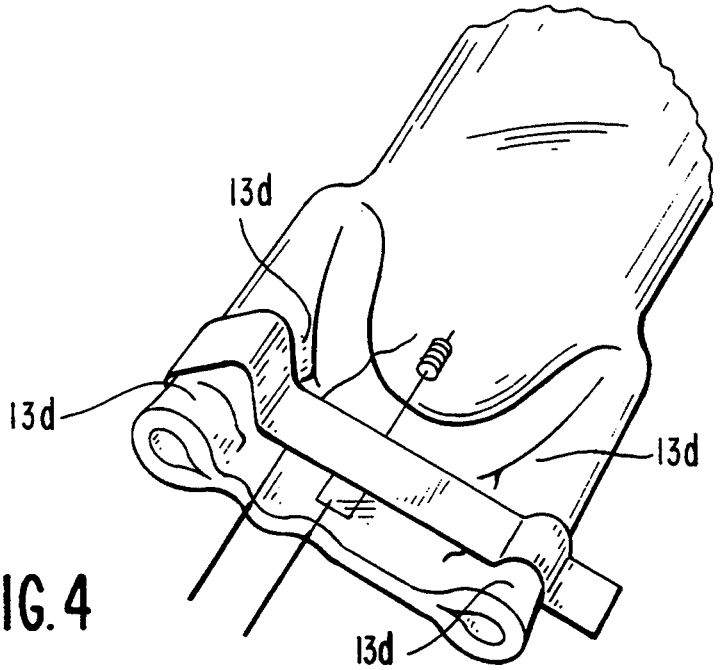
FIG. 4 is a perspective view of the press seal and support strap shown in FIGS. 2 and 3.

Despite the spring clamping force of the strap at six points of the seal, dimples 13*d* are formed on both major faces of the press seal and on both sides of the strap to prevent axial slippage of the metallic strap along the otherwise smooth glossy press seal. (FIG. 4).

In an exemplary embodiment in a 400 W metal halide lamp, the strip was 0,010 thick stainless steel having a width of 0.250". The strap shown in FIGS. 2–4 was found to reliably hold a press seal despite variations of about 1 mm in the width of the seal.

While the strap according to the preferred embodiment includes two elastically deformable portions, it should be recognized that for some applications one may be sufficient. Furthermore, the arms 22*f, g* of portion 22*c* shown in FIGS. 2–4 are dimensioned such that the strap is biased against the major seal faces at points C1, C4 and on the major seal faces at points C2, C6. The straps could be dimensioned such that portion 22*c* causes strap clamping forces only at points C1, C4 or only at points C2, C6. When two elastically deformable portions are used, it is also feasible that one portion causes clamping on the major seal faces such as at C2, C6 or at C3, C5 and the other at the minor seal faces at C1, C4. Additionally, the deformable portions need not be arranged on the same side of a major seal face.

Since the support rods 21, 26 do not extend along the body 17 of the discharge vessel, there are no current-carrying metal parts in direct view of the discharge. While frames of this type are known, for example from the above-mentioned Canale '480 patent, the use of the support strap according to the invention improves the frame by lowering its cost through ease of assembly while maintaining or improving its reliability with respect to similar frames having straps according to the prior art.

While there has been shown what is presently considered to be the preferred embodiment of the invention, those of ordinary skill in the art will appreciate that other variations are permissible within the scope of the invention as defined by the appended claims. For example, the straps according to the invention can readily be used for supporting the press seal of tungsten halogen lamps. Furthermore, the straps could also be constructed such that the elastically deformable portions also undergo some plastic deformation in addition to the elastic deformation when being assembled on the press seal.

What is claimed is:

1. In an electric lamp having a light source capsule energizeable for emitting light and including a generally planar seal sealing said capsule in a gas-tight manner, said seal having two generally parallel major faces and two opposing minor faces extending transversely between said major faces, a support rod extending adjacent a minor face of said seal, and a metallic support strap extending about and holding said seal and fixed to said support rod, the improvement comprising:

said support strap including a stiffly resilient strip of metal having two spaced and opposing major leg portions each extending in contact with a respective major seal face, an elastically deformable jaw portion the major portion of which is not in contact with a said seal face, and end portions fixed to each other adjacent one of said seal faces, said elastically deformable jaw portion being arranged such that with said end portions fixed to each other adjacent said one seal face said elastically deformable portion is elastically deformed and firmly biases other portions of said support strap against at least two of said seal faces for holding said seal therebetween.

2. In an electric lamp according to claim 1, wherein said elastically deformable jaw portion is arranged such that when said end portions of said strap are closed together, said elastically deformable jaw portion is elastically deformed in the direction along said major seal faces, and with said end portions fixed together, said support strap is firmly biased against both of said minor seal faces.

3. In an electric lamp according to claim 2, wherein said elastically deformable jaw portion includes two arms extending generally transversely to said major seal faces.

4. In an electric lamp according to claim 2, wherein said elastically deformable jaw portion is arranged such that when said end portions of said strap are closed together, said elastically deformable jaw portion is also deformed in the direction transverse to said major seal faces and said support strap is also firmly based against both of said major seal faces.

5. In an electric lamp according to claim 4, wherein said elastically deformable jaw portion is arranged adjacent the other minor seal face opposite said one minor seal face which is adjacent said end portions and includes two arms extending generally transversely to said major seal faces, one of said arms extending in contact with said other minor seal face.

6. In an electric lamp according to claim 5, wherein said strap includes a second elastically deformable jaw portion.

7. In an electric lamp according to claim 6, wherein said support strap has width and thickness dimensions uniform over its entire length.

8. In an electric lamp according to claim 7, wherein said lamp is a high pressure discharge lamp and said light source capsule is a discharge vessel having a press seal at opposing ends thereof, discharge electrodes arranged within said discharge vessel, and a discharge sustaining filling in which a discharge is maintained between said discharge electrodes during lamp operation.

9. In an electric lamp according to claim 2, wherein said strap includes a second elastically deformable jaw portion, said second elastically deformable portion being arranged such that when said end portions of said strap are closed together, said elastically deformable jaw portion is deformed in the direction transverse to said minor seal faces, and with said end portions fixed together, said support strap is firmly biased against both of said major seal faces.

10. In an electric lamp according to claim 1, wherein said lamp is a high pressure discharge lamp and said light source capsule is a discharge vessel having a press seal at opposing ends thereof, discharge electrodes arranged within said discharge vessel, and a discharge sustaining filling in which a discharge is maintained between said discharge electrodes during lamp operation.

11. In an electric lamp according to claim 1, wherein said support strap consists of a single strip of said stiffly resilient material.

12. In an electric lamp according to claim 11, wherein said end portions are fixed to each other adjacent one of said minor seal faces.

13. A high pressure gas discharge lamp having an outer lamp envelope including a lamp stem and an opposing dome end;

a light source arranged generally axially within said outer lamp envelope, said light source including a discharge vessel consisting of a fused silica body and having a planar press seal at each end thereof, an alkali-halide containing discharge sustaining filling, a pair of discharge electrodes within said discharge vessel body between which an arc discharge is maintained during lamp operation, and conductive lead-throughs extending from each electrode through a respective press seal to the exterior of said discharge vessel, said press seal having two generally parallel major faces and two opposing minor faces extending between said major faces, said discharge vessel emitting ultraviolet radiation during lamp operation;

a metallic support strap extending about and holding each of said press seals;

a first metallic frame section extending from said lamp stem and fixed to said support strap on said press seal facing said lamp stem; and a second metallic support frame section engaging said dome end of said envelope and fixed to said support strap on said press seal facing said dome end of said envelope, the improvement comprising:

each of said support frames include only a single axially extending support rod connected to said support straps, said support rods extending only as far as their respective seals and not extending along said discharge vessel body; and each of said support straps includes a stiffly resilient metallic strip having two opposing major portions each contacting a respective major press seal face, an elastically deformable jaw portion, the major part of which is not in contact with a said seal face, connecting said two major leg portions at the minor seal face facing away from said support rod, and end portions fixed to each other adjacent said other minor seal face and fixed to said support rod, said elastically deformable jaw portion being arranged such that with said end portions fixed to said support rod said elastically deformable jaw portion is elastically deformed and firmly biases other portions of said strap against at least one of (i) both of said major seal faces and (ii) both of said minor seal faces holding said seal therebetween.

14. A high pressure discharge lamp according to claim 13, wherein said elastically deformable jaw portion is generally U-shaped and has a pair of arms extending generally transversely from respective ones of said major leg portions, one of said arms being longer than the other and extending in contact with said minor seal face remote from said support rod.

15. A high pressure discharge lamp according to claim 14, wherein said strap includes a second elastically deformable jaw portion adjacent one of said end portions of said strap.

16. A high pressure discharge lamp according to claim 15, wherein said support strap has a width and thickness dimension uniform over its entire length.

17. A high pressure discharge lamp according to claim 16, wherein said lamp is a metal halide lamp and said discharge sustaining filling includes mercury, a sodium halide and another metal halide.

18. A high pressure discharge lamp according to claim 13, wherein said strap consists of a single strip of said stiffly resilient material.

19. A support strap for a light source of an electric lamp having a generally planar seal with a pair of generally parallel major faces and a pair of minor faces extending therebetween, said strap comprising: a single stiffly resilient strip of metal having two spaced and opposing major leg portions each for contacting a respective major seal face, an elastically deformable jaw portion connecting said two leg portions and extending generally transversely to said two leg portions, and end portions opposite said elastically deformable jaw portion, said elastically deformable portion being arranged such that, with strap arranged on a said seal with said major portions contacting a respective seal face and said end portions fixed to each other adjacent one of said minor seal faces, said elastically deformable jaw portion is elastically deformed and firmly biases other portions of said strap against at least one of (a) both of said major seal faces and (b) both of said minor seal faces, for holding said seal therebetween.

20. A support strap according to claim 19, wherein said elastically deformable jaw portion includes a generally U-shaped portion having arms extending generally transversely from respective ones of said major leg portions, one of said arms being longer than the other and extending in contact with said other minor seal face.

21. A support strap according to claim 20, wherein said strap includes a second elastically deformable jaw portion adjacent one of said end portions of said strap.

22. A support strap according to claim 21, wherein said support strap has a width and thickness dimension uniform over its entire length.

23. A support strap according to claim 20, wherein said U-shaped portion is arranged with said major leg portions extending at an acute angle with respect to each other such that said end portions are splayed open and a press seal can be readily inserted between said major leg portions.

24. A support strap according to claim 19, wherein said strap includes a second elastically deformable portion adjacent one of said end portions of said strap.

* * * * *